US010273616B1

(12) United States Patent
Kawasaki

(10) Patent No.: US 10,273,616 B1
(45) Date of Patent: Apr. 30, 2019

(54) CADDY FOR SEWING ITEMS

(71) Applicant: CLOVER MFG. CO., LTD., Osaka-shi, Osaka (JP)

(72) Inventor: Yuji Kawasaki, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 0 days.

(21) Appl. No.: 15/726,058

(22) Filed: Oct. 5, 2017

(51) Int. Cl.
*D05B 91/14* (2006.01)

(52) U.S. Cl.
CPC ..... *D05B 91/14* (2013.01)

(58) Field of Classification Search
CPC ..... D05B 91/14; D05B 91/12; B65D 25/10
See application file for complete search history.

(56) References Cited

U.S. PATENT DOCUMENTS 2,600,589 A * 6/1952 Swanson ..... D05B 91/12 206/350
2,667,394 A * 1/1954 Goetz ..... D05B 91/12 206/380
3,363,775 A * 1/1968 Shaw ..... B25H 3/04 211/70.6
3,982,631 A * 9/1976 Kunik ..... B65D 83/02 206/350
2017/0144797 A1* 5/2017 Kawasaki ..... B65D 21/0222

FOREIGN PATENT DOCUMENTS

JP 2017-95826 A 6/2017

* cited by examiner

*Primary Examiner* — Shaun R Hurley
*Assistant Examiner* — Andrew Wayne Sutton
(74) *Attorney, Agent, or Firm* — Hamre, Schumann, Mueller & Larson, P.C.

(57) ABSTRACT

A caddy for sewing items includes a hollow housing, and first/second elongated permanent magnets contained in the housing. The second magnet is arranged in parallel to and spaced from the first magnet. The housing includes first/second attracting surfaces and an elongated groove between the first and second attracting surfaces. The first magnet has an upper surface S-pole corresponding to the first attracting surface, and the second magnet has an upper surface N-pole corresponding to the second attracting surface. The groove extends in parallel to the first/second magnets and has a first longitudinal edge connected to the first attracting surface and a second longitudinal edge connected to the second attracting surface. The first and second longitudinal edges are curved so that their center portion is higher than other portions as viewed in the direction in which the first/second magnets are spaced apart from each other.

3 Claims, 6 Drawing Sheets

CADDY FOR SEWING ITEMS

FIELD

The present disclosure relates to a caddy for holding items including needles for sewing. More particularly, the present disclosure relates to a caddy for holding elongated items that are attracted to magnets.

BACKGROUND

Conventionally, handicraft needles such as sewing needles or dress pins are stored, when not in use, as stuck on the stuffing of a pin cushion. As a different type from this, JP-A-2017-95826 discloses a holder that uses the attraction force of a magnet.

Generally, in a structure for holding a plurality of needles using the attraction force of a magnet, a lot of needles tend to overlap on the attracting surface. In such a case, it is difficult to remove the needles one by one from the attracting surface. In this respect, the conventional holder still has room for improvement.

SUMMARY

The caddy for sewing items according to the present disclosure has been proposed in view of these circumstances. It is therefore an object of the present disclosure to provide a caddy that can attract and hold a plurality of products such as sewing needles so as not to overlap with each other.

A caddy for sewing items provided according to an embodiment of the present disclosure includes a hollow housing; an elongated first permanent magnet contained in the housing; and an elongated second permanent magnet contained in the housing, where the second permanent magnet is arranged in parallel to and spaced apart from the first permanent magnet. The housing includes a first attracting surface, a second attracting surface, and an elongated groove positioned between the first and the second attracting surfaces. The first permanent magnet has an upper surface S-pole corresponding in position to the first attracting surface. The second permanent magnet has an upper surface N-pole corresponding in position to the second attracting surface. The groove extends in parallel to the first and the second permanent magnets as viewed in plan. The groove includes a first longitudinal edge connected to the first attracting surface and a second longitudinal edge connected to the second attracting surface. Each of the first and the second longitudinal edges is curved in such a manner that a center portion thereof is higher than other portions as viewed in a separating direction in which the first and the second permanent magnets are spaced apart from each other.

Other features and advantages will become apparent from the detailed description given below with reference to the accompanying drawings.

EMBODIMENTS

Embodiments of the caddy for sewing items according to the present disclosure are described below with reference to the accompanying drawings.

Figure 1:
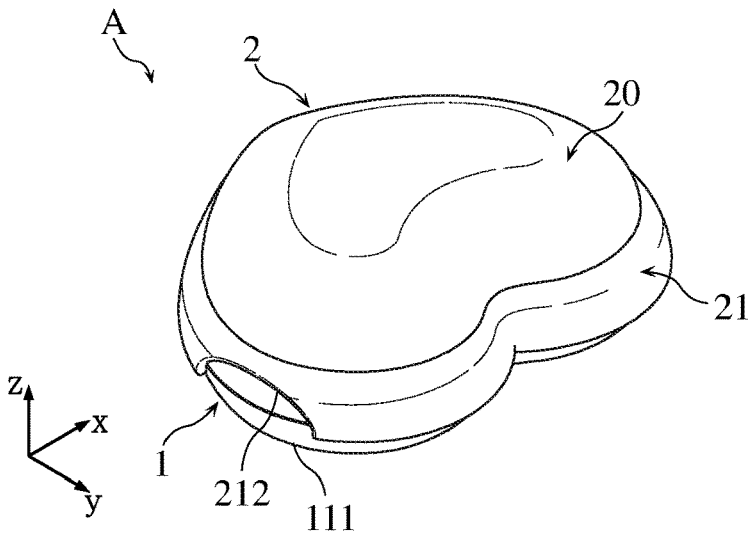
FIG. 1 is a perspective view showing a caddy for sewing items according to an embodiment.
Figure 2:
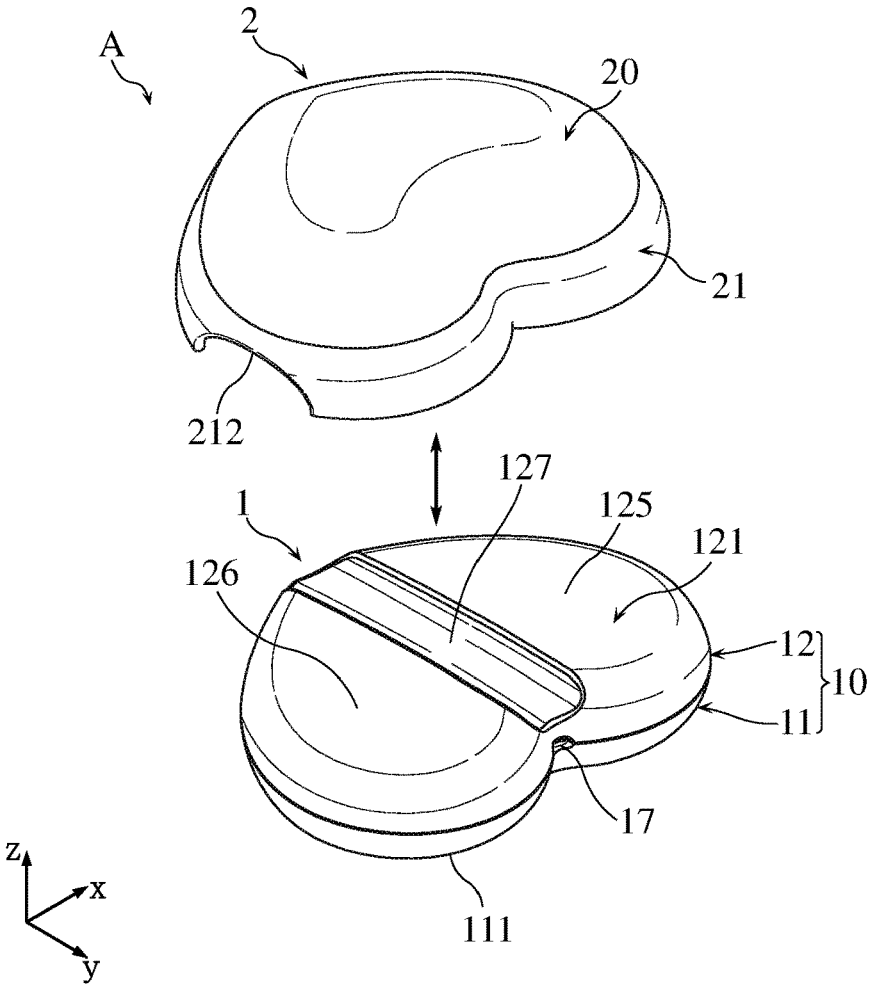
FIG. 2 is an exploded perspective view of the caddy for sewing items.
Figure 3:
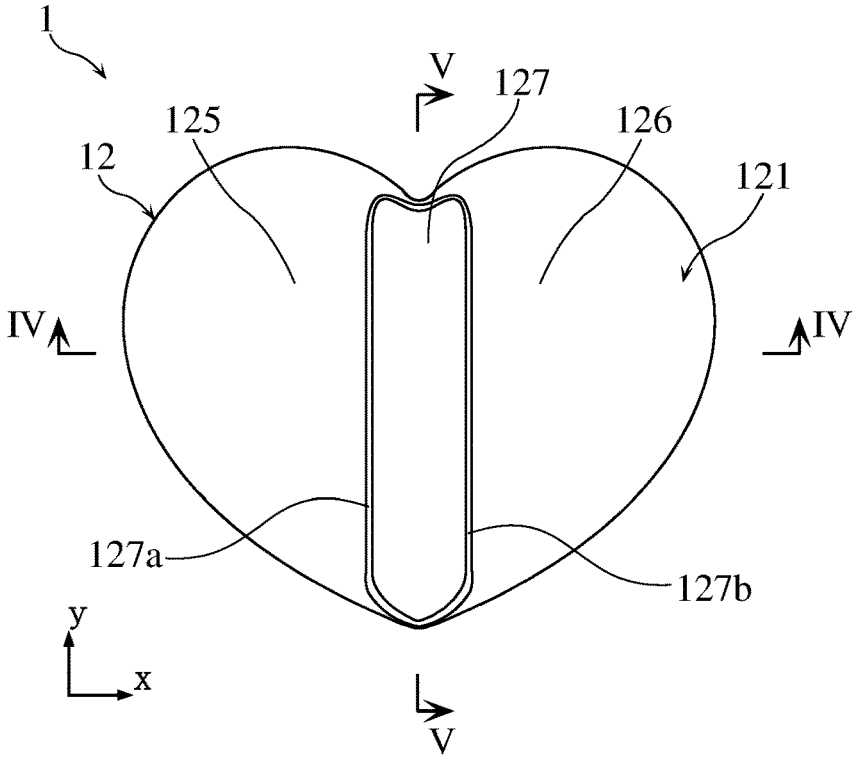
FIG. 3 is a plan view showing a main body of the caddy for sewing items.

FIGS. 1-7 show a caddy for sewing items according to an embodiment. The illustrated caddy A includes a main body 1 and a cover 2 attachable to the main body 1. FIG. 1 is a perspective view showing the state in which the cover 2 is attached to the main body 1. FIG. 2 is a perspective view showing the state in which the cover 2 is detached from the main body 1. FIG. 3 is a plan view of the main body 1.

As shown in FIGS. 4-9, the main body 1 includes a housing 10, a magnetic member 14, and a plurality of (two in the present embodiment) permanent magnets 15 and 16. The housing 10 contains in it the magnetic member 14 and the permanent magnets 15 and 16. The housing 10 is made up of a lower case 11 and an upper case 12. The housing 10 (the lower case 11 and the upper case 12) may be made of a synthetic resin having an appropriate strength. The lower case 11 and the upper case 12 are bonded together by ultrasonic welding or using an adhesive, for example. The housing 10 (and hence the main body 1) is heart shaped as viewed in plan (see FIG. 3). However, the present disclosure is not limited to this.

Figure 4:
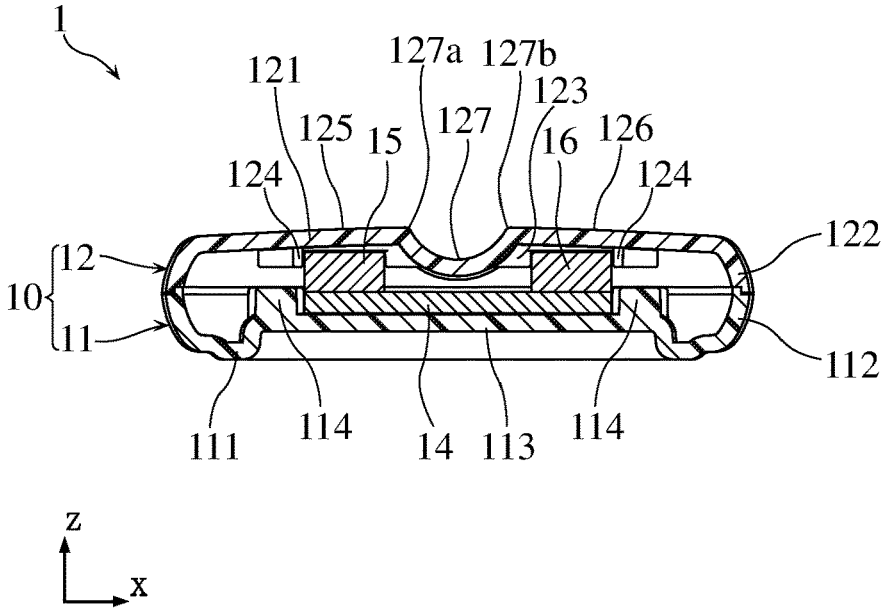
FIG. 4 is a sectional view taken along lines IV-IV in FIG. 3.
Figure 5:
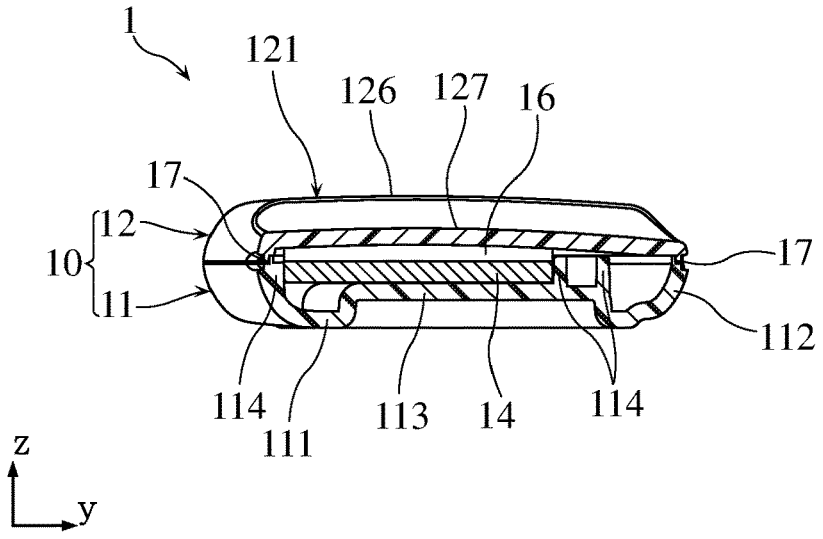
FIG. 5 is a sectional view taken along lines V-V in FIG. 3.

As shown in FIGS. 4 and 5, the lower case 11 has a bottom portion 111, a side wall (outer circumferential wall) 112, a raised portion 113 and a plurality of projections 114. The bottom portion 111 is heart shaped as viewed in plan. The side wall 112 extends upward from the outer peripheral edge of the bottom portion 111. The raised portion 113 and each of the projections 114 are positioned inward of the side wall 112. The raised portion 113 is at a higher position relative to the bottom portion 111 (see the direction z). Each of the projections 114 is integrally formed on the raised portion 113 and extends upward relative to the upper surface of the raised portion 113. Thus, with respect to the bottom portion 111, the upper surface of each projection 114 is positioned higher than the upper surface of the raised portion 113. The raised portion 113 is in the form of a flat plate and has a flat upper surface on which the magnetic member 14 is disposed.

The plurality of projections 114 are arranged as spaced apart from each other to surround the magnetic member 14 and are in contact with at least the magnetic member 14 to prevent displacement of the magnetic member 14 in the horizontal direction (direction perpendicular to the direction z). The plurality of projections 114 may all have the same configuration (shape, size and so on) or may have different configurations from each other. As an example of the latter case, it may be considered that, like the present embodiment, at least one projection 114 is in the form of a solid column (see FIG. 4), while another projection 114 is in the form of a hollow cylinder (see FIG. 5). Each projection 114 and the magnetic member 14 do not need to be in constant contact with each other but may be configured to have a slight spacing between them in the horizontal direction.

The permanent magnets 15 and 16 are attracted to and held on the magnetic member 14 due to magnetic force. Thus, prevention of displacement of the magnetic member 14 contributes to prevention of displacement of the permanent magnets 15 and 16. To be more cautious, the height of each projection 114 may be adjusted in such a manner that the projections 114 come into contact with the permanent magnets 15 and 16 as well. The permanent magnets 15 and 16 may be more firmly fixed to the magnetic member 14.

The means for preventing displacement of the magnetic member 14 (and hence the permanent magnets 15 and 16) is not limited to the plurality of projections 114 described above. For example, instead of the plurality of projections 114, a wall portion continuously surrounding the magnetic member 14 may be provided.

The upper case 12 has an upper wall 121 and a side wall (outer circumferential wall) 122. The upper wall 121 is heart shaped as viewed in plan. The side wall 122 extends downward from the outer peripheral edge of the upper wall 121. A plurality of projections 123 and another set of projections 124 are provided on the inner side of the side wall 122. Each of the projections 123 and 124 extends downward from the inner surface of the side wall 122. The projections 123 and 124 prevent displacement of the permanent magnets 15 and 16 in the horizontal direction. The plurality of projections 124 are located at positions corresponding in the direction z to the plurality of projections 114 of the lower case 11, respectively.

The upper surface of the upper wall 121 includes attracting surfaces 125 and 126 spaced apart from each other. The upper wall 121 is further provided with a groove 127 flanked by the two attracting surfaces 125 and 126. As shown in FIG. 3, the groove 127 is elongated along the direction y. The attracting surfaces 125 and 126 and the groove 127 are described later in detail.

An engagement groove 17 is provided at the outer circumferential surface of the portion at which the lower case 11 and the upper case 12 are bonded together. The engagement groove 17 is described later in detail.

The magnetic member 14 prevents the magnetic field of the permanent magnets 15 and 16 from spreading downward. The magnetic member 14 is a thin plate that is rectangular as viewed in plan. The magnetic member 14 is made of a ferromagnetic material such as iron or iron-based alloy, but may be made of other ferromagnetic materials (e.g. nickel (Ni) or cobalt (Co)).

The two permanent magnets 15 and 16 are disposed on the upper surface of the magnetic member 14 and spaced apart from each other in the direction x so as to be located at positions corresponding to the two attracting surfaces 125 and 126, respectively. As shown in FIG. 4, each of the permanent magnets 15 and 16 is in the form of a column having a rectangular cross section and may be a ferrite magnet. In the example shown in the figure, the cross section of each permanent magnet 15, 16 is longer in the horizontal direction than in the vertical direction. Each permanent magnet 15, 16 is elongated and extends substantially in parallel to the groove 127 (i.e., along the direction y). In the housing 10, the permanent magnets 15 and 16 are held at proper positions with respect to the horizontal direction by the projections 123 and 124 of the upper case 12 (and the projections 114 of the lower case 11).

Figure 6:
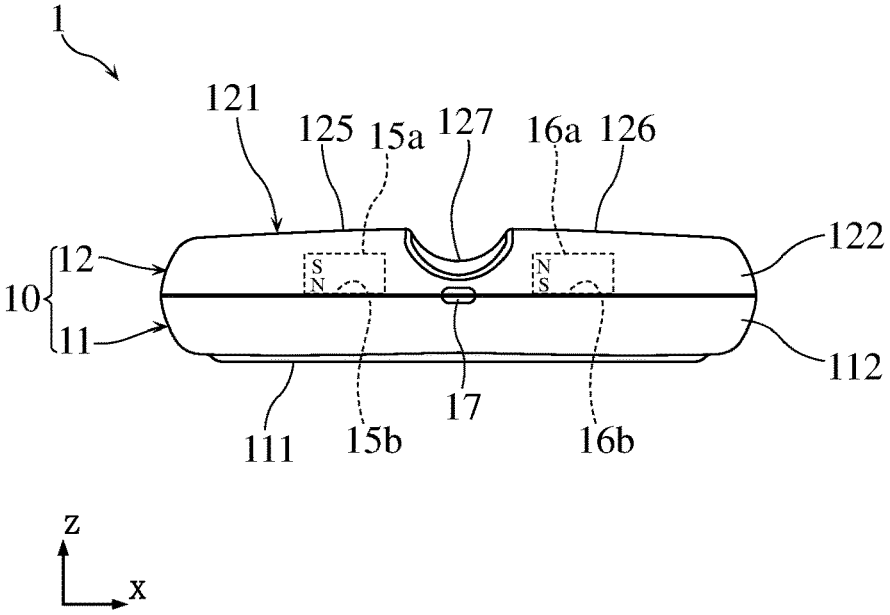
FIG. 6 is a side view of the main body.

The permanent magnets 15 and 16 are arranged such that respective magnetic pole surfaces of N-pole and S-pole are opposite to each other in the vertical direction. For example, as shown in FIG. 6, the permanent magnet 15 has an upper surface of the S-pole and a lower surface of the N-pole, whereas the permanent magnet 16 has an upper surface of the N-pole and a lower surface of the S-pole. With such an arrangement, a strong magnetic force causing attraction to each other is generated between the two permanent magnets 15 and 16 (between the upper magnetic pole surfaces 15*a* and 16*a* in particular) in the horizontal direction.

As shown in FIGS. 3 and 4, the attracting surfaces 125 and 126 of the upper wall 121 are spaced apart from each other in the direction x. The attracting surfaces 125 and 126 overlap with the permanent magnets 15 and 16, respectively, as viewed in the thickness direction (direction z) of the main body 1.

As shown in FIG. 3, the groove 127 is formed between the attracting surfaces 125 and 126 and extends from one end to the other end of the upper wall 121 along the direction y. The groove 127 has two longitudinal edges 127*a* and 127*b* that are parallel to each other and spaced apart from each other in the direction x. In the present embodiment, the groove 127 is provided at the center of the upper wall 121 in the direction x. As shown in FIG. 4, the groove 127 may have an arcuate cross section. The cross section of the groove 127 is not limited to an arcuate shape and may have a different shape. In each cross section perpendicular to the direction y (one of the cross sections is shown in FIG. 4), the longitudinal edges 127*a* and 127*b* of the groove 127 are at the same height, and the attracting surfaces 125 and 126 are substantially entirely positioned lower than the both of the longitudinal edges 127*a* and 127*b*.

In the present embodiment, the longitudinal edge 127*a* is connected to the attracting surface 125 and corresponds to the boundary between the attracting surface 125 and the curved surface of the groove 127. The longitudinal edge 127*b* is connected to the attracting surface 126 and corresponds to the boundary between the attracting surface 126 and the curved surface of the groove 127. As will be understood from FIG. 5, the longitudinal edge 127*b* is gently curved to be upwardly convex as viewed in the direction x. Similarly, the longitudinal edge 127*a* is gently curved to be upwardly convex as viewed in the direction x (see FIG. 7).

Figure 7:
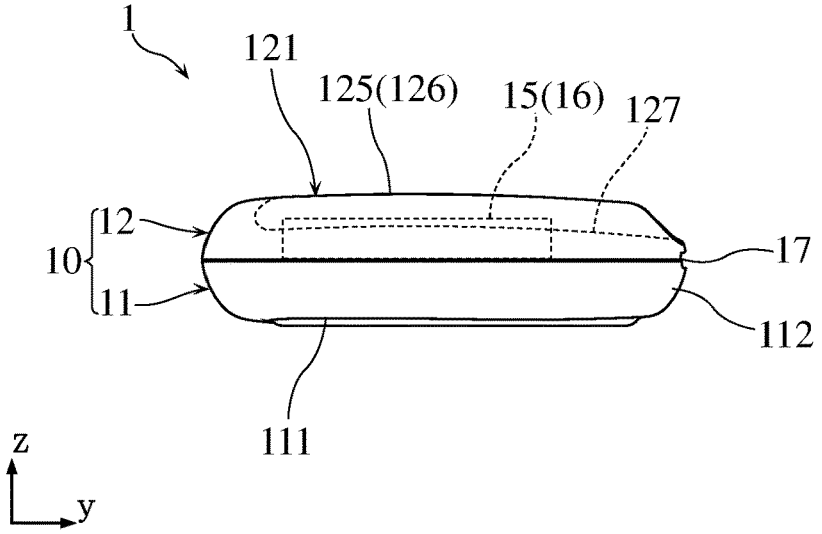
FIG. 7 is a front view of the main body.

As shown in FIGS. 5 and 7, each of the attracting surfaces 125 and 126 is a curved surface and becomes higher as approaching the center in the direction y. In the present embodiment, each of the attracting surfaces 125 and 126 is gently curved to be upwardly convex, and its center portion in the direction y is higher than other portions in that direction. The degree of curve of the attracting surfaces 125 and 126 or the distance of the attracting surfaces 125 and 126 from the permanent magnets 15 and 16 are set appropriately in accordance with the size of the main body 1 or arrangement of the permanent magnets 15 and 16 contained in the housing 10, for example. As an example, each of the permanent magnets 15 and 16 is 10 to 15 mm in dimension in the direction x, 30 to 50 mm in dimension in the direction y, and 5 to 10 mm in dimension in the direction z. The distance between the permanent magnets 15 and 16 in the direction x is 15 to 25 mm. As to the degree of curve of the attracting surfaces 125 and 126, the radius of curvature of the attracting surfaces 125 and 126 as viewed in the direction x is 50 to 100 cm, for example. The distance from the permanent magnets 15 and 16 to the attracting surfaces 125 and 126 in the direction z is 2 to 4 mm, for example.

As described above, in the present embodiment, the attracting surfaces 125 and 126 are gently curved to be upwardly convex. Instead of this, each of the attracting surfaces 125 and 125 may include one or a plurality of inclined flat faces. In this case again, each of the attracting surfaces 125 and 126 is configured such that its center in the direction y is at the highest position. As viewed in the direction x (see FIGS. 5 and 7), the inclination angle of each attracting surface 125, 126 (the angle of an inclined flat face on the right side or left side of the center) may be in the range of 2 to 3 degrees with respect to the horizontal plane.

In this embodiment, as shown in FIGS. 4 and 6, each attracting surface 125, 126 becomes higher as approaching the groove 127. Each attracting surface 125, 126 is inclined as viewed in the direction y, and the inclination angle is 2 to 3 degrees, for example, with respect to the horizontal plane.

The cover 2 can be attached so as to cover the upper portion of the main body 1. The cover 2 has a ceiling portion 20 that is an upper portion and a skirt portion 21 that is a lower portion. The ceiling portion 20 is heart shaped as viewed in plan. The skirt portion 21 extends downward from the periphery of the ceiling portion 20 and is curved. The cover 2 may be made of a synthetic resin having an appropriate strength.

Figure 8:
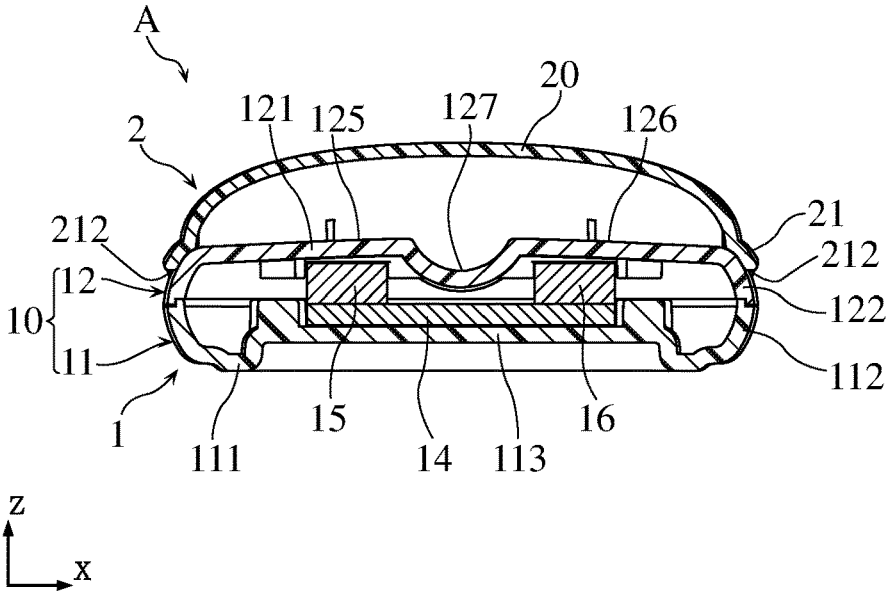
FIG. 8 is a sectional view showing the state in which the cover is attached to the main body.
Figure 9:
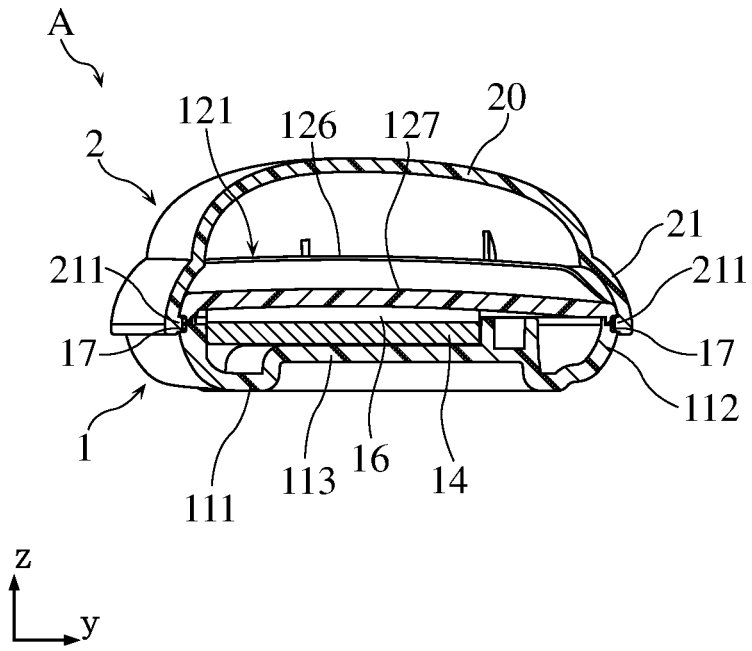
FIG. 9 is another sectional view showing the state in which the cover is attached to the main body.

FIGS. 8 and 9 show the state in which the cover 2 is attached to the main body 1. In this state, a space is defined between the ceiling portion 20 of the cover 2 and the main body 1 (the upper wall 121 of the upper case 12). In the present embodiment, the ceiling portion 20 covers the upper wall 121 as spaced apart from the main body 1 (the upper wall 121 of the upper case 12).

In FIGS. 8 and 9, the skirt portion 21 covers the almost entire side wall 122 of the upper case 12 and a part of the side wall 112 of the lower case 11 (see also FIG. 1). That is, the skirt portion 21 partially covers the curved side surface of the main body 1. The skirt portion 21 has an inner circumferential surface formed with a plurality of engagement projections 211 (FIG. 9) at appropriate positions. In attaching the cover 2, each engagement projection 211 engages with the one engagement groove 17 of the main body 1. The skirt portion 21 is provided with at least one cutout 212. As shown in FIGS. 1 and 2, the cutout 212 is formed in such a manner as to break the continuity of the lower edge of the skirt portion 21 and exposes a part of the side wall 122 of the upper case 12. In the present embodiment, as shown in FIG. 8, the skirt portion 21 is formed with two cutouts 212 spaced apart from each other in the direction x.

Figure 10:
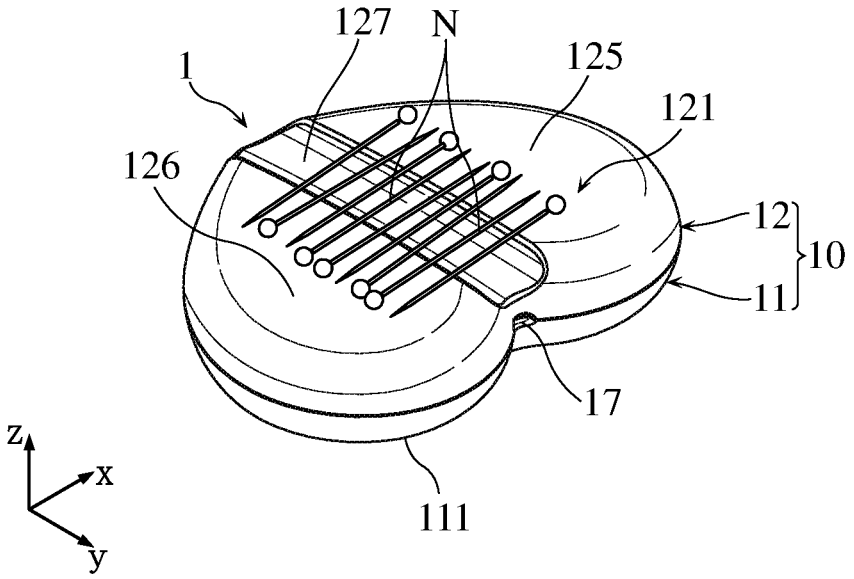
FIG. 10 is a perspective view showing an example of use of the caddy for sewing items.
Figure 11:
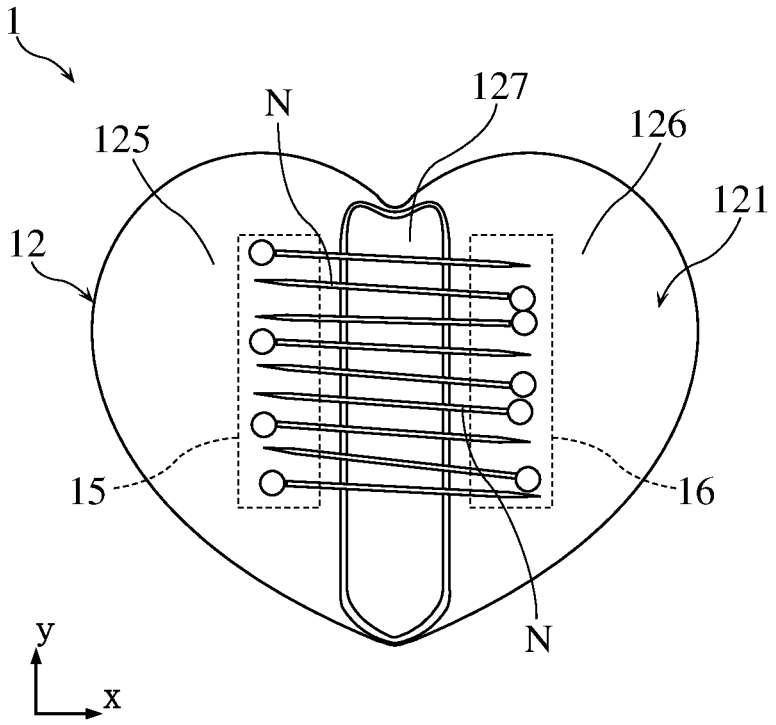
FIG. 11 is a plan view showing an example of use of the caddy for sewing items.

The use and advantages of the above-described caddy A are described below with reference to FIGS. 10 and 11. In these figures, dress pins N are exemplarily shown as a plurality of products held on the caddy A. As will be easily understood, the present disclosure is not limited to this example, and other kinds of products can also be held by the caddy A. Since the caddy A uses a magnetic force to hold products, the target products are things that are attracted to magnets (ferromagnetic materials). Examples of ferromagnetic metal elements include Fe, Ni and Co. Products made of a material containing these metal elements (e.g. alloys or compounds) can be held by the caddy A.

In use of the caddy A, a dress pin N is placed on the placement surface (the upper surface of the upper wall 121, including the attracting surfaces 125 and 126) of the main body 1. In the example shown in FIGS. 10 and 11, a plurality of dress pins N are attracted to and held on the placement surface.

In placing another dress pin N on the placement surface of the main body 1, the dress pin N is instantaneously attracted to and held on the attracting surfaces 125 and 126 due to the magnetic force of the permanent magnets 15 and 16. Due to the magnetic force of the two permanent magnets 15 and 16 arranged as spaced apart from each other, the plurality of dress pins N are held in parallel to the direction in which the two permanent magnets 15 and 16 are spaced apart from each other (i.e., across the groove 127) without being oriented in different directions from each other. Moreover, since the groove 127 is provided, a space is defined between the attracted dress pins N and the main body 1. Thus, in removing each dress pin N from the attracting surfaces 125 and 126, the dress pin N can be easily picked up with fingers.

The magnetic force acting between the magnetic pole surfaces 15*a* and 16*a* of the permanent magnets 15 and 16 is relatively large at the center in the direction y in which the permanent magnets 15 and 16 extend. In the present embodiment, the attracting surfaces 125 and 126 become higher as approaching the center in the direction y. This arrangement makes the magnetic force acting at the attracting surfaces 125 and 126 uniform along the direction y. As a result, as will understood from FIGS. 10 and 11, when a plurality of dress pins N are placed on the upper wall 121, these dress pins N are held on the attracting surface 125 and 126 as properly dispersed in the direction y. That is, even when a plurality of dress pins N are placed on the upper wall 121, these dress pins N are prevented from gathering on the attracting surfaces 125 and 126. This allows a desired dress pin N to be removed easily from the plurality of dress pins N that are attracted and held.

In the present embodiment, each attracting surface 125, 126 becomes higher as approaching the groove 127 as seen in the direction y (see FIG. 6). This arrangement prevents an excessive attracting and holding force from acting on the dress pins N placed on the attracting surfaces 125 and 126. Moreover, according to this arrangement, products such as dress pins N are substantially held by the above-described longitudinal edges 127*a* and 127*b* alone, and the products do not come into direct contact with the attracting surfaces 125 and 126. Thus, the plurality of dress pins N placed on the caddy A become spaced apart from each other automatically (i.e., due to the magnetic force).

The inner circumferential surface of the skirt portion 21 of the cover 2 has engagement projections 211 (FIG. 9). Further, the outer circumferential surface of the main body 1 has the engagement groove 17 with which the engagement projections 211 are engageable. This arrangement prevents the cover 2 attached to the main body 1 from being unintentionally detached from the main body 1. The cover 2 has a cutout 212 (see FIGS. 1, 2 and 8). According to this arrangement, in detaching the attached cover 2 from the main body 1, the cover 2 can be easily detached from the main body 1 by putting a finger on the portion exposed through the cutout 212.

In the foregoing embodiment, the caddy A provided with the cover 2 is described. Unlike this, the caddy for sewing items may not be provided with the cover 2 but may consist solely of the main body 1.

The caddy for sewing items of the present disclosure is not limited to the foregoing embodiment. The specific structure of each part of the caddy for sewing items may be varied in various ways without departing from the scope defined by the claims.

The invention claimed is:

1. A caddy for sewing items, the caddy comprising:

a hollow housing;

an elongated first permanent magnet contained in the housing; and an elongated second permanent magnet contained in the housing, the second permanent magnet being arranged in parallel to and spaced apart from the first permanent magnet, wherein the housing includes a first attracting surface, a second attracting surface, and an elongated groove positioned between the first and the second attracting surfaces, the first permanent magnet having an upper surface S-pole corresponding in position to the first attracting surface, the second permanent magnet having an upper surface N-pole corresponding in position to the second attracting surface, the groove extends in parallel to the first and the second permanent magnets as viewed in plan, the groove includes a first longitudinal edge connected to the first attracting surface and a second longitudinal edge connected to the second attracting surface, and each of the first and the second longitudinal edges is curved in such a manner that each of the longitudinal edges has a center portion and the center portion of each of the longitudinal edges is higher than other portions as viewed in a separating direction in which the first and the second permanent magnets are spaced apart from each other.

2. The caddy for sewing items according to claim 1, wherein each of the first and the second longitudinal edges is curved to be convex toward an outside of the housing as viewed in the separating direction.

3. The caddy for sewing items according to claim 1, wherein each of the first and the second attracting surfaces becomes higher as approaching the groove as viewed in a longitudinal direction of the first and the second permanent magnets.

* * * * *